US009293815B1

(12) United States Patent
Horner et al.

(10) Patent No.: US 9,293,815 B1
(45) Date of Patent: Mar. 22, 2016

(54) ULTRA-WIDEBAND HEMISPHERICAL TEARDROP ANTENNA WITH A CONICAL GROUND

(71) Applicants: Robert Sylvester Horner, San Diego, CA (US); Lawrence Todd Short Bull, San Diego, CA (US); Robert Joseph Motyl, Oceanside, CA (US)

(72) Inventors: Robert Sylvester Horner, San Diego, CA (US); Lawrence Todd Short Bull, San Diego, CA (US); Robert Joseph Motyl, Oceanside, CA (US)

(73) Assignee: THE UNITED STATES OF AMERICA AS REPRESENTED BY THE SECRETARY OF THE NAVY, Washington, DC (US)

( * ) Notice: Subject to any disclaimer, the term of this patent is extended or adjusted under 35 U.S.C. 154(b) by 227 days.

(21) Appl. No.: 14/035,340

(22) Filed: Sep. 24, 2013

(51) Int. Cl.
*H01Q 1/36* (2006.01)
*H01Q 1/48* (2006.01)

(52) U.S. Cl.
CPC ... *H01Q 1/36* (2013.01); *H01Q 1/48* (2013.01)

(58) Field of Classification Search
CPC ..... H01Q 1/36; H01Q 9/28; H01Q 9/40
USPC ..... 343/846, 848, 899, 908
See application file for complete search history.

(56) References Cited

U.S. PATENT DOCUMENTS

| | | | | |
|---|---|---|---|---|
| 2,368,663 | A | 2/1945 | Kandoian | |
| 3,364,491 | A | 1/1968 | Stohr | |
| 4,074,268 | A * | 2/1978 | Olson | 342/399 |
| 5,923,299 | A | 7/1999 | Brown et al. | |
| 5,991,474 | A | 11/1999 | Baldi | |
| 6,845,253 | B1 * | 1/2005 | Schantz | 455/575.7 |
| 7,495,618 | B2 | 2/2009 | Kurashima et al. | |
| 7,843,398 | B1 | 11/2010 | Horner | |
| 7,973,731 | B2 * | 7/2011 | Parsche | 343/772 |
| 8,063,842 | B2 * | 11/2011 | Kurashima et al. | 343/773 |
| 2010/0156742 | A1 | 6/2010 | Yanagi et al. | |
| 2014/0118209 | A1 * | 5/2014 | Yona | H01Q 9/40 343/775 |

FOREIGN PATENT DOCUMENTS

| | | | | |
|---|---|---|---|---|
| JP | 2004129209 | * | 4/2004 | H01Q 1/36 |

OTHER PUBLICATIONS

Simpson et al., Comparing Pulse Radiation from the Unloaded Ice Cream Cone and Resistively Loaded Cone, 2011 IEEE International Symposium on Antennas and Propagation (APSURS), Jul. 3, 2011, pp. 3309-3312.

* cited by examiner

*Primary Examiner* — Sue A Purvis
*Assistant Examiner* — Patrick Holecek
(74) *Attorney, Agent, or Firm* — Spawar Systems Center Pacific; Kyle Eppele; Ryan J. Friedl

(57) ABSTRACT

An ultra-wideband antenna is provided. The antenna includes a cone shaped ground element and a radiating element. The cone shaped ground element has a first vertex region and an aperture formed through the first vertex region. The cone shaped ground element is configured to form an electrical ground. The radiating element includes a cone shaped radiator and a spherical shaped radiator. The cone shaped radiator has a second vertex region that is electrically connectable to a feed element mounted through the aperture of the cone shaped ground element. The spherical shaped radiator is mounted to the cone shaped radiator opposite the second vertex region.

18 Claims, 7 Drawing Sheets

ULTRA-WIDEBAND HEMISPHERICAL TEARDROP ANTENNA WITH A CONICAL GROUND

REFERENCE TO GOVERNMENT RIGHTS

The United States Government has ownership rights in this invention. Licensing inquiries may be directed to Office of Research and Technical Applications, Space and Naval Warfare Systems Center, Pacific, Code 72120, San Diego, Calif., 92152; telephone (619)553-5118; email: ssc_pac_t2@navy.mil. Reference Navy Case No. 101794.

BACKGROUND

In some applications, ultra-wide band antennas are needed to operate over a large field-of-view (FOV) in both azimuth and elevation directions. The typical bicone or monocone antenna does not provide a sufficient FOV particularly at higher elevations because the pattern is strongly influenced by a null at the apex (vertical direction).

SUMMARY

In an illustrative embodiment, an ultra-wideband antenna is provided. The antenna includes, but is not limited to, a cone shaped ground element and a radiating element. The cone shaped ground element includes, but is not limited to, a first vertex region and an aperture formed through the first vertex region. The cone shaped ground element is configured to form an electrical ground. The radiating element includes, but is not limited to, a cone shaped radiator and a spherical shaped radiator. The cone shaped radiator includes, but is not limited to, a second vertex region that is electrically connectable to a feed element mounted through the aperture of the cone shaped ground element. The spherical shaped radiator is mounted to the cone shaped radiator opposite the second vertex region.

In another illustrative embodiment, an ultra-wideband antenna is provided. The antenna includes, but is not limited to, a cone shaped ground element, a radiating element, and a spacer. The cone shaped ground element includes, but is not limited to, a first vertex region and an aperture formed through the first vertex region. The cone shaped ground element is configured to form an electrical ground. The radiating element includes, but is not limited to, a cone shaped radiator and a spherical shaped radiator. The cone shaped radiator includes, but is not limited to, a second vertex region that is electrically connected to a feed element mounted through the aperture of the cone shaped ground element. The spherical shaped radiator is mounted to the cone shaped radiator opposite the second vertex region. The spacer is mounted to the cone shaped ground element and to the radiating element and configured to maintain a spacing between the cone shaped ground element and the radiating element.

In yet another illustrative embodiment, an ultra-wideband antenna is provided. The antenna includes, but is not limited to, a feed element, a cone shaped ground element, and a radiating element. The cone shaped ground element includes, but is not limited to, a first vertex region and an aperture formed through the first vertex region. The cone shaped ground element is configured to form an electrical ground. The radiating element includes, but is not limited to, a cone shaped radiator and a spherical shaped radiator. The cone shaped radiator includes, but is not limited to, a second vertex region that is electrically connected to the feed element mounted through the aperture of the cone shaped ground element. The spherical shaped radiator is mounted to the cone shaped radiator opposite the second vertex region.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
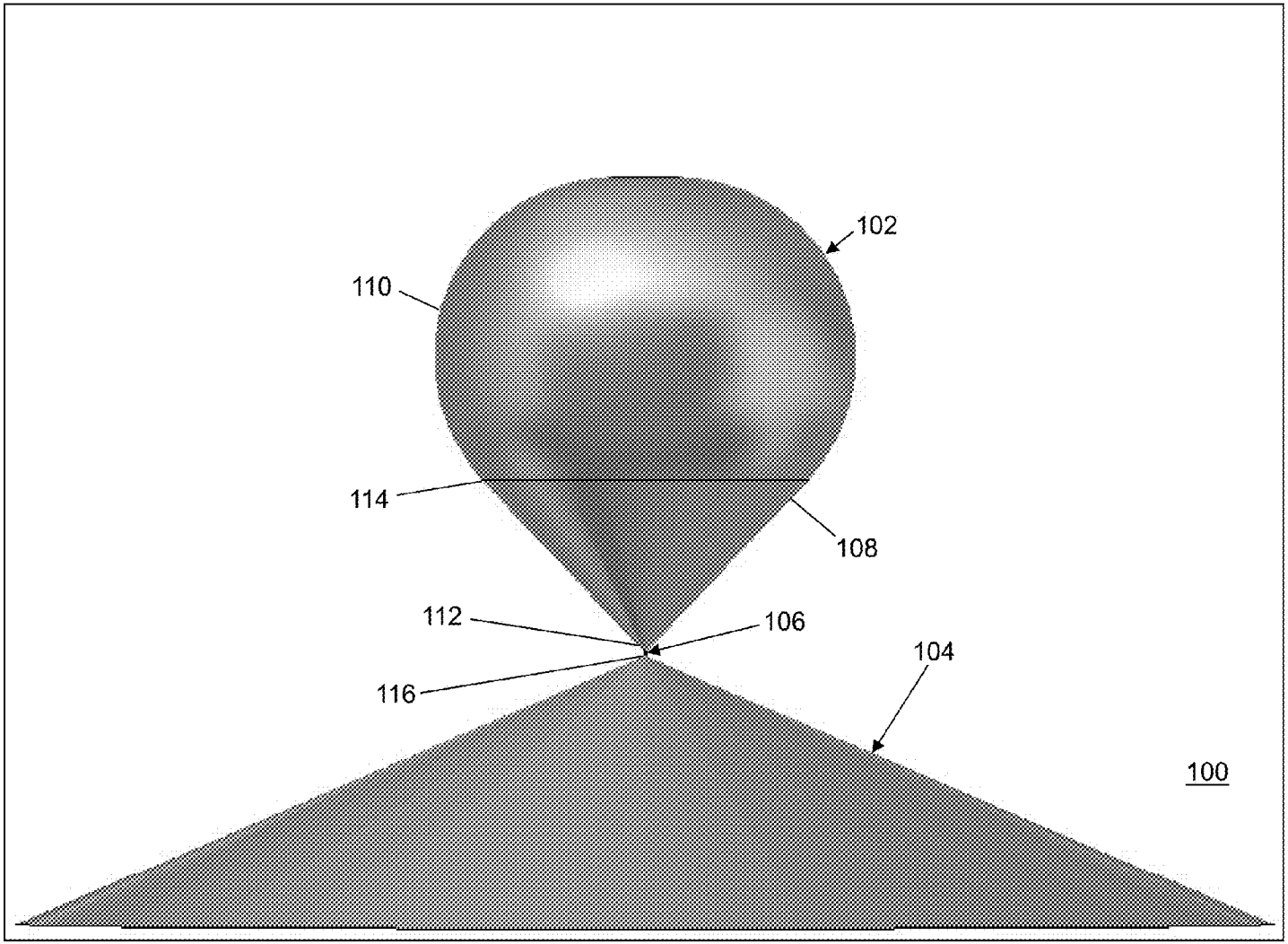
FIG. 1 depicts a side view of an antenna in accordance with an illustrative embodiment.

With reference to FIG. 1, a side view of an antenna 100 is shown in accordance with an illustrative embodiment. Antenna 100 may include a radiating element 102, a cone shaped ground element 104, and a feed element 106. Radiating element 102 may include a cone shaped radiator 108 and a spherical shaped radiator 110 to form a teardrop shaped radiator. Antenna 100 can receive vertically polarized signals with a hemispherical pattern from −5 degrees up to 70 degrees in elevation.

Cone shaped radiator 108 may include a vertex region 112 that is electrically connected to feed element 106. Spherical shaped radiator 110 is mounted to cone shaped radiator 108 opposite vertex region 112 along a transition region 114.

Cone shaped radiator 108 and spherical shaped radiator 110 may be formed of any conducting material suitable for forming a radiator of antenna 100. For example, cone shaped radiator 108 and spherical shaped radiator 110 may be formed of a metallic material such as copper, brass, etc. as understood by a person of skill in the art. Cone shaped radiator 108 and spherical shaped radiator 110 may be formed of the same or different materials.

Cone shaped ground element 104 may include a vertex region 116 and an aperture 404 (shown with reference to FIG. 4) formed through vertex region 116. Cone shaped ground element 104 is electrically grounded and may be formed of any material suitable for forming an electrical ground for antenna 100. For example, cone shaped ground element 104 may be formed of a metallic material such as copper, brass, etc. as understood by a person of skill in the art.

Feed element 106 is mounted through aperture 404 of cone shaped ground element 104. Feed element 106 may include a receptacle 700 (shown with reference to FIG. 7) and a length of coaxial cable 702 (shown with reference to FIG. 7). Receptacle 700 may be mounted to vertex region 116 of cone shaped ground element 104. An inner conductor of the length of coaxial cable 702 may be electrically connected to vertex region 112 of cone shaped radiator 108. An outer conductor of the length of coaxial cable 702 may be electrically connected to vertex region 116 of cone shaped ground element 104.

Figure 2:
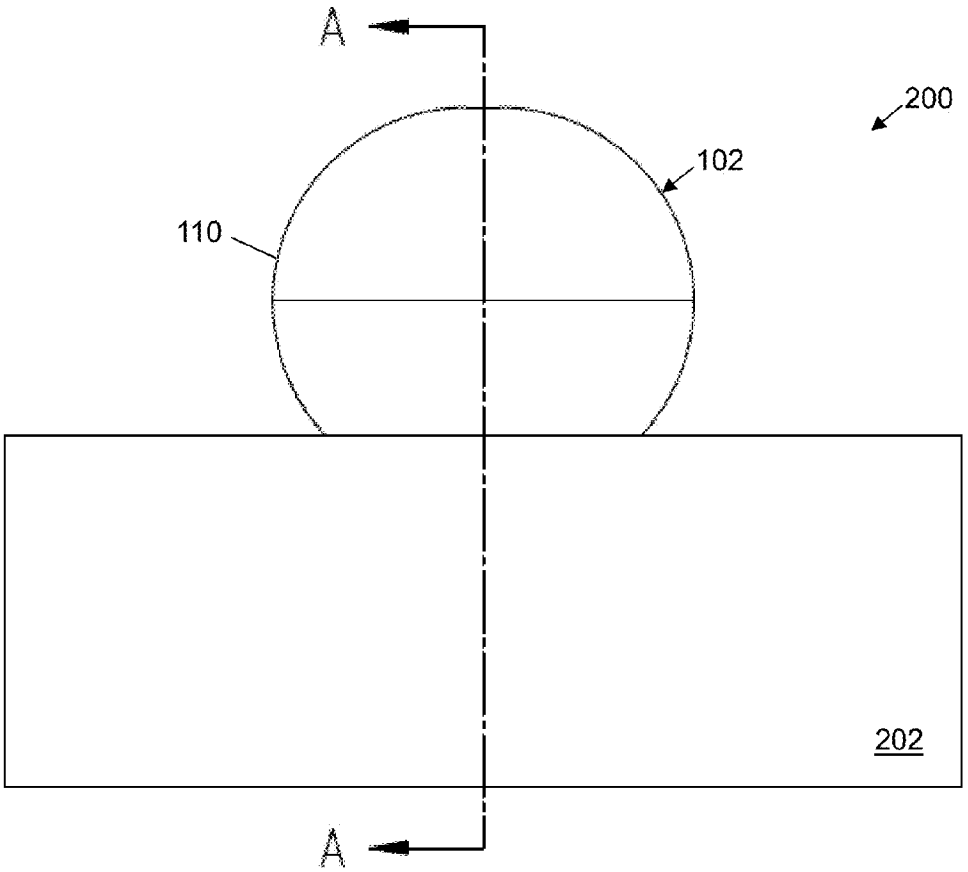
FIG. 2 depicts a side view of the antenna of FIG. 1 with a spacer mounted between a radiating element and a ground element of the antenna in accordance with an illustrative embodiment.

With reference to FIG. 2, a side view of a second antenna 200 is shown in accordance with an illustrative embodiment. Second antenna 200 may include antenna 100 and a spacer 202. Spacer 202 is mounted to cone shaped ground element 104 and to radiating element 102, for example, using an adhesive material. Spacer 202 may be formed of a dielectric material such as a rigid polyurethane material such as ECCOSTOCK® SH manufactured by Emerson & Cuming Microwave Products Inc. of Randolph Mass. though other materials may be used. Spacer 202 supports radiating element 102 to maintain a correct positioning between cone shaped ground element 104 and radiating element 102. Spacer 202 may be transparent or visible to radio frequency (RF) signals depending on the application.

Figure 3:
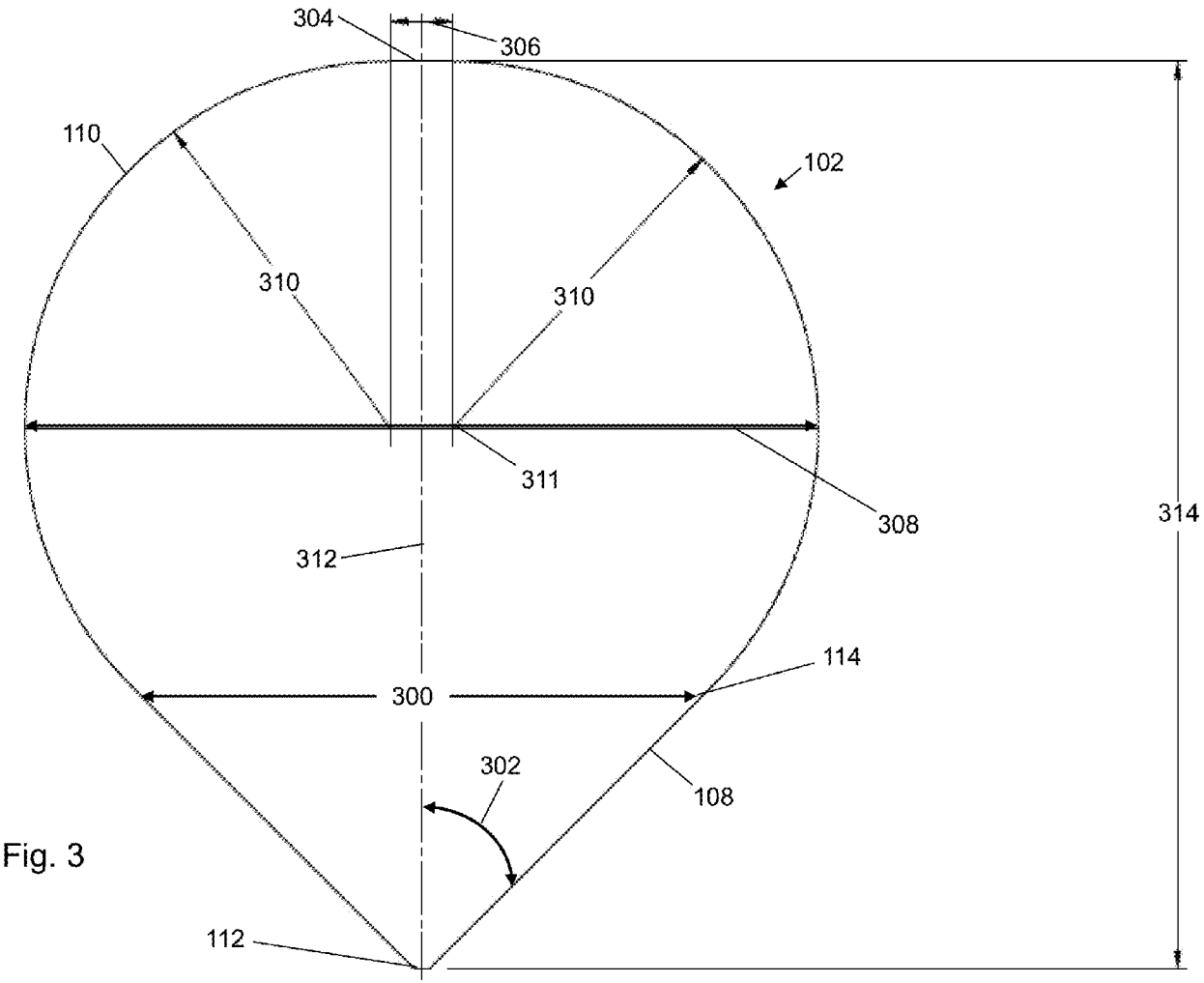
FIG. 3 depicts a side view of the radiating element of the antenna of FIG. 1 in accordance with an illustrative embodiment.

With reference to FIG. 3, a side view of radiating element 102 is shown in accordance with an illustrative embodiment. Cone shaped radiator 108 has a cone shape from vertex region 112 to transition region 114. At transition region 114, the cone shape transitions to a spherical shape. In an illustrative embodiment, a diameter 300 of cone shaped radiator 108 at transition region 114 is between two and three inches. In an illustrative fabricated antenna, diameter 300 of cone shaped radiator 108 at transition region 114 was approximately three inches (3.051 inches in fabricated antenna). A cone half-angle 302 of cone shaped radiator 108 at vertex region 112 is between 30 and 60 degrees. In an illustrative fabricated antenna, cone half-angle 302 of cone shaped radiator 108 at vertex region 112 was approximately 45 degrees. Cone shaped radiator 108 may include an aperture 704 (shown with reference to FIG. 7) through which a portion of feed element 106 is inserted. For example, aperture 704 may be an approximately 0.080 inch diameter hole in vertex region 112 of cone shaped radiator 108.

Spherical shaped radiator 110 has a spherical shape from transition region 114 to a top 304. In the illustrative embodiment, top 304 has a flat shape though this merely facilitates fabrication of radiating element 102. Top 304 may have a flat shape with a top diameter 306 of approximately 0.3 inches (0.33 inches in illustrative fabricated antenna). Spherical shaped radiator 110 may have a sphere diameter 308 of approximately four inches (4.178 inches in illustrative fabricated antenna). Spherical shaped radiator 110 may have a radius of curvature 310 of less than two inches, for example, radius of curvature 310 was 1.924 inches in an illustrative fabricated antenna.

The surface of spherical shaped radiator 110 curves away from top 304 with radius of curvature 310 from a center of curvature 311. Center of curvature 311 is located a distance from a rotational axis of symmetry 312 equal to top diameter 306 divided by two. The surface of spherical shaped radiator 110 continues to curve until it reaches an angle below a plane defined at sphere diameter 308. The angle may be approximately equal to cone half-angle 302 of cone shaped radiator 108. At transition region 114, a diameter of a circle through spherical shaped radiator 110 in a plane perpendicular to rotational symmetry axis 312 is approximately equal to diameter 300 of cone shaped radiator 108. Radiating element 102 may have a height 314 between vertex region 112 of cone shaped radiator 108 and top 304 of spherical shaped radiator 110. In an illustrative embodiment, height 314 is approximately five inches (4.769 inches in illustrative fabricated antenna).

Figure 4:
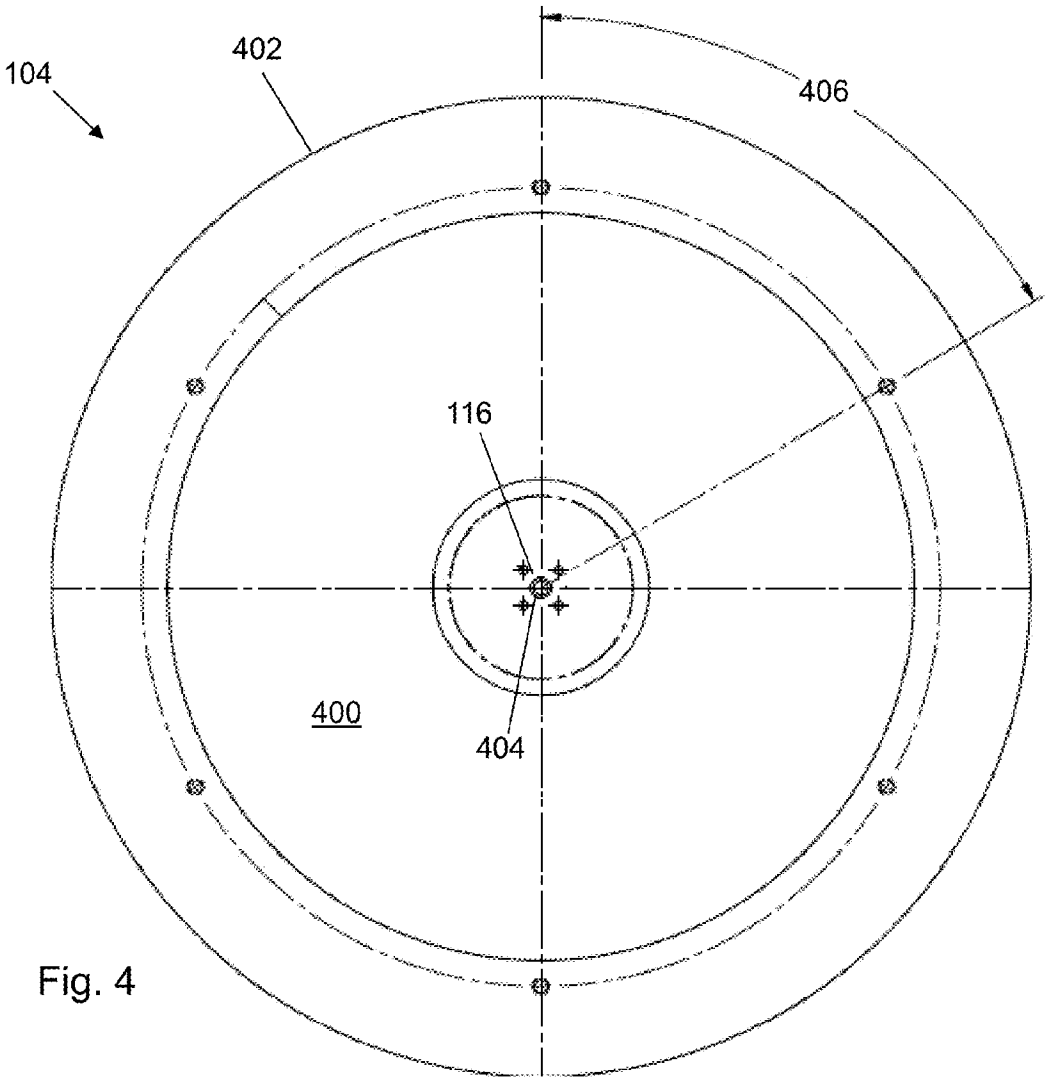
FIG. 4 depicts a bottom view of the ground element of the antenna of FIG. 1 in accordance with an illustrative embodiment.

With reference to FIG. 4, a top view of radiating element 102 is shown in accordance with an illustrative embodiment. Cone shaped ground element 104 has a cone shaped surface 400 from vertex region 116 to a base 402. Cone shaped ground element 104 may include an aperture 404 through which a portion of feed element 106 is inserted With reference to FIG. 5, a side view of radiating element 102 is shown in accordance with an illustrative embodiment. Cone shaped ground element 104 has a cone half-angle 500 at vertex region 116 of between 60 and 75 degrees. In an illustrative fabricated antenna, cone half-angle 500 of cone shaped ground element 104 was approximately 68 degrees. Cone shaped ground element 104 has a maximum diameter 502. In an illustrative fabricated antenna, maximum diameter 502 of cone shaped ground element 104 was approximately 9.5 inches. In general, if cone shaped ground element 104 is larger than sphere diameter 308 of radiating element 102, antenna 100 is effective as a radiator. For example, if maximum diameter 502 of cone shaped ground element 104 is larger by a factor of 1.5 to three times than sphere diameter 308 of radiating element 102, antenna 100 is effective as a radiator.

Figure 5:
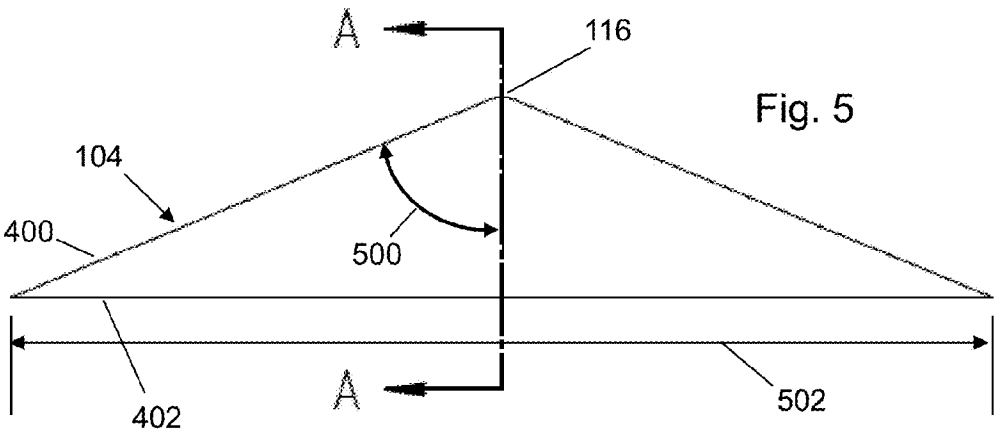
FIG. 5 depicts a side view of the ground element of FIG. 4 in accordance with an illustrative embodiment.
Figure 6:
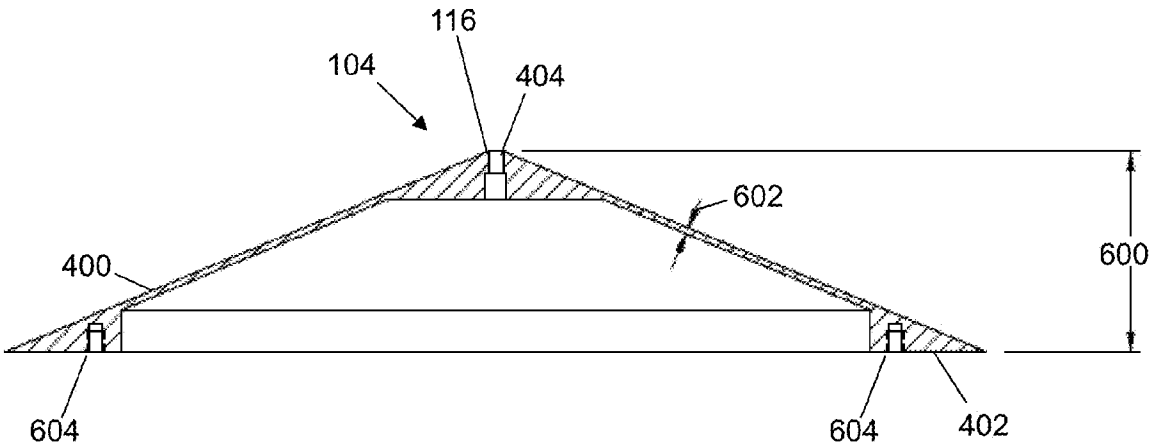
FIG. 6 depicts a side cross-sectional view of the ground element taken through a section A-A as indicated in FIG. 5 in accordance with an illustrative embodiment.

With reference to FIG. 6, a side cross-sectional view of cone shaped ground element 104 taken through a section A-A as indicated in FIG. 5 is shown in accordance with an illustrative embodiment. Cone shaped ground element 104 has a height 600 between base 402 and vertex region 116. In an illustrative fabricated antenna, height 600 of cone shaped ground element 104 was approximately two inches (1.94 inches in illustrative fabricated antenna). A wall thickness of cone shaped ground may vary though a majority of a wall of cone shaped ground element 104 may be less than 0.1inches (0.06 inches in illustrative fabricated antenna).

Cone shaped ground element 104 further may include a plurality of apertures 604 formed in, but not through, surface 400. Adjacent apertures of the plurality of apertures 604 may be separated by a spacing angle 406 (shown with reference to FIG. 4). The plurality of apertures 604 may be sized and shaped to accept a fastener to allow mounting of cone shaped ground element 104 to a mounting flange (not shown).

Figure 7:
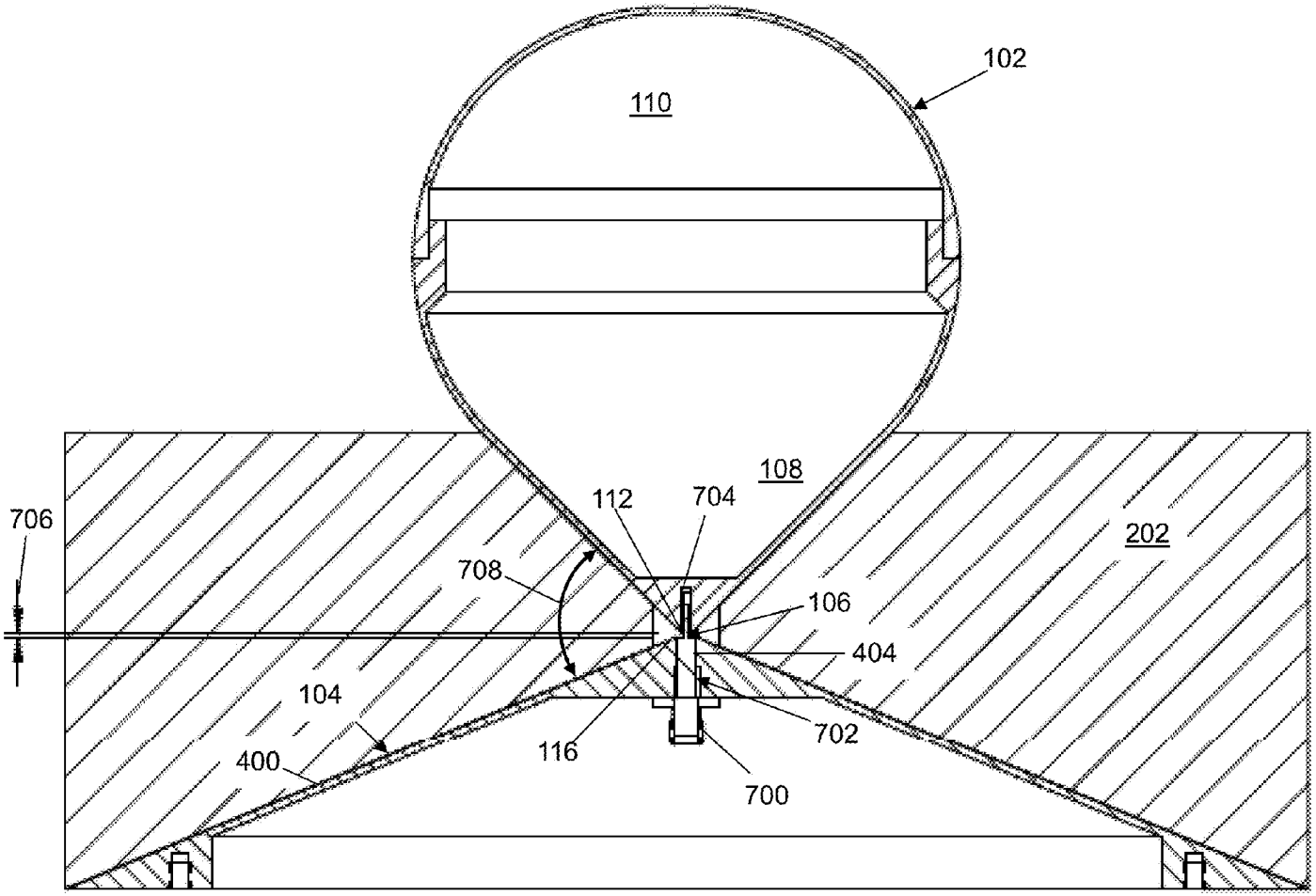
FIG. 7 depicts a side cross-sectional view of the antenna of FIG. 2 taken through a section A-A as indicated in FIG. 2 in accordance with an illustrative embodiment.

With reference to FIG. 7, a side cross-sectional view of second antenna 200 taken through a section A-A as indicated in FIG. 2 is shown in accordance with an illustrative embodiment. Vertex region 116 of cone shaped ground element 104 and vertex region 112 of cone shaped radiator 108 are separated by a distance 706. In an illustrative fabricated antenna, distance 706 was less than 0.1 inches (0.03 to 0.05 inches in illustrative fabricated antenna).

Second antenna 200 may be designed to match a standard 50-Ohm coaxial cable to match the "intrinsic impedance of free space", which is ~377 Ohms. This match may be selected based on an angle 708 between cone shaped radiator 108 and cone shaped ground element 104. For illustration, angle 708 is ~67 degrees though angle 708 can be varied and still achieve acceptable results as understood by a person of skill in the art. A receiver may be electrically coupled to feed element 106 to receive a receive signal from second antenna 200 or to send a transmit signal to second antenna 200 for radiation by second antenna 200 as understood by a person of skill in the art.

Figure 8:
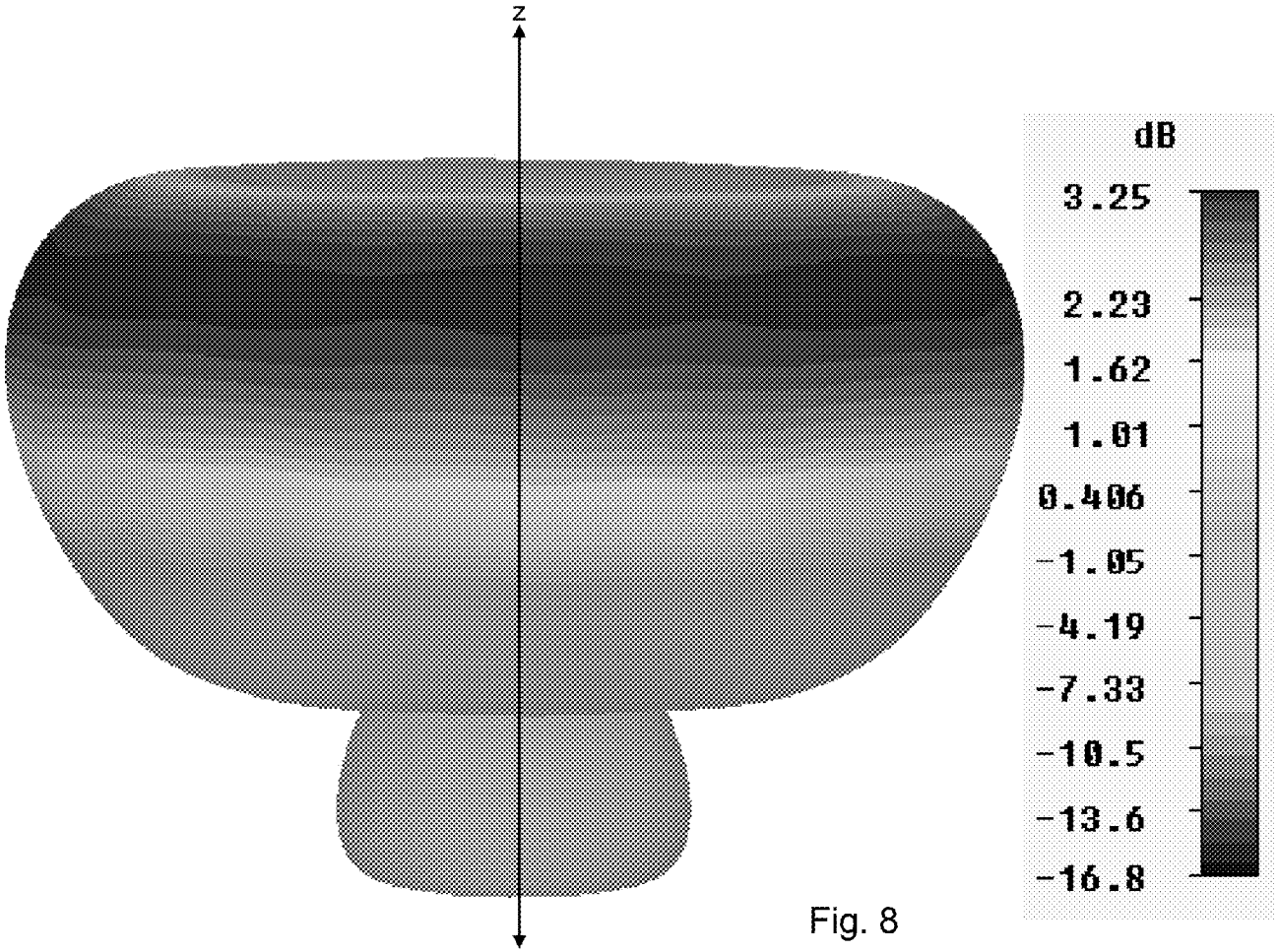
FIG. 8 is a graph showing a three-dimensional radiation pattern for the antenna of FIG. 2 in accordance with an illustrative embodiment.

With reference to FIG. 8, a three-dimensional radiation pattern for second antenna 200 is shown in the far field at 2.6 gigahertz (GHz). In the illustrative embodiment, second antenna 200 can operate from 1 GHz to 18 GHz. Second antenna 200 can receive vertically polarized signals with a hemispherical pattern from −5 degrees up to 70 degrees in elevation. Second antenna 200 can be combined with a polarizer (not shown) to detect slant polarized RF radiation. Inclusion of spherical shaped radiator 110 extending from cone shaped radiator 108 increases the elevation gain allowing second antenna 200 to transmit/receive from the horizon to higher elevations than achieved previously. Below the horizon, at an angle of −5 degrees, cone shaped ground element 104 improves the gain by 1 to 4 decibels at 1 GHz.

In alternative embodiments, cone shaped ground element 104 could have a shape similar to radiating element 102 or have rounded edges (i.e. chamfered edges).

As used in this disclosure, the term "mount" includes join, unite, connect, couple, associate, insert, hang, hold, affix, attach, fasten, bind, paste, secure, bolt, screw, rivet, pin, nail, clasp, clamp, cement, fuse, solder, weld, glue, form over, slide together, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact, but are mounted together via intermediate elements). Elements referenced as mounted to each other herein may further be integrally formed together, for example, using a molding process as understood by a person of skill in the art. As a result, elements described herein as being mounted to each other need not be discrete structural elements. The elements may be mounted permanently, removable, or releasable.

The dimensions provided herein are illustrative as one skilled in the art could deviate from these dimensions and obtain similar results. The word "illustrative" is used herein to mean serving as an illustrative, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

It will be understood that many additional changes in the details, materials, steps and arrangement of parts, which have been herein described and illustrated to explain the nature of the invention, may be made by those skilled in the art within the principle and scope of the invention as expressed in the appended claims. The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated. It is intended that the scope of the disclosed subject matter be defined by the claims appended hereto and their equivalents.

What is claimed is:

1. An antenna comprising:

a cone shaped ground element comprising a first vertex region and an aperture formed through the first vertex region, wherein the cone shaped ground element is configured to form an electrical ground, wherein a cone half-angle of the cone shaped ground element is greater than 60 degrees and less than or equal to 75 degrees; and a radiating element comprising a cone shaped radiator and a spherical shaped radiator, wherein the cone shaped radiator comprises a cone shape from a second vertex region to a transition region and the spherical shaped radiator comprises a spherical shape from the transition region to a top surface, wherein the second vertex region is electrically connectable to a feed element mounted through the aperture of the cone shaped ground element, wherein a cone half-angle of the cone shaped radiator is between 30 degrees and 60 degrees, wherein the spherical shaped radiator is mounted to the cone shaped radiator opposite the second vertex region such that the shape of the radiating element transitions from the cone shape of the cone shaped radiator to the spherical shape of the spherical shaped radiator at the transition region, wherein the angle between the cone shaped radiator and the cone shaped ground element is about 67 degrees.

2. The antenna of claim 1, wherein the cone half-angle of the cone shaped ground element is approximately 68 degrees.

3. The antenna of claim 1, wherein a maximum diameter of the cone shaped ground element is approximately 9.5 inches.

4. The antenna of claim 1, wherein a wall thickness of a majority of a wall of the cone shaped ground element is less than 0.1 inches.

5. The antenna of claim 4, wherein the wall thickness is approximately 0.06 inches.

6. The antenna of claim 1, further comprising a spacer mounted between the cone shaped ground element and the radiating element using an adhesive material.

7. The antenna of claim 6, wherein the spacer is formed of a dielectric material.

8. The antenna of claim 7, wherein the dielectric material is a rigid polyurethane material.

9. The antenna of claim 1, wherein a distance between the first vertex region and the second vertex region is less than 0.1 inches.

10. The antenna of claim 9, wherein the distance is less than or equal to 0.05 inches.

11. The antenna of claim 1, wherein the cone half-angle of the cone shaped radiator is approximately 45 degrees.

12. The antenna of claim 1, wherein a maximum diameter of the cone shaped radiator is between two and four inches.

13. The antenna of claim 12, wherein a maximum diameter of the cone shaped radiator is approximately three inches.

14. The antenna of claim 1, wherein a radius of curvature of the spherical shaped radiator is less than or equal to two inches.

15. The antenna of claim 14, wherein the radius of curvature is approximately 1.9 inches.

16. An antenna comprising:

a cone shaped ground element comprising a first vertex region and an aperture formed through the first vertex region, wherein the cone shaped ground element is configured to form an electrical ground, wherein a cone half-angle of the cone shaped ground element is greater than 60 degrees and less than or equal to 75 degrees;

a radiating element comprising a cone shaped radiator and a spherical shaped radiator, wherein the cone shaped radiator comprises a cone shape from a second vertex region to a transition region and the spherical shaped radiator comprises a spherical shape from the transition region to a top surface, wherein the second vertex region is electrically connected to the feed element mounted through the aperture of the cone shaped ground element, wherein a cone half-angle of the cone shaped radiator is between 30 degrees and 60 degrees, wherein the angle between the cone shaped radiator and the cone shaped ground element is about 67 degrees, wherein the spherical shaped radiator is mounted to the cone shaped radiator opposite the second vertex region such that the shape of the radiating element transitions from the cone shape of the cone shaped radiator to the spherical shape of the spherical shaped radiator at the transition region; and a spacer mounted to the cone shaped ground element and to the radiating element and configured to maintain a spacing between the cone shaped ground element and the radiating element.

17. The antenna of claim 16, wherein the spacer is formed of a dielectric material.

18. An antenna comprising:

a feed element;

a cone shaped ground element comprising a first vertex region and an aperture formed through the first vertex region, wherein the cone shaped ground element is configured to form an electrical ground, wherein a cone half-angle of the cone shaped ground element is greater than 60 degrees and less than or equal to 75 degrees; and a radiating element comprising a cone shaped radiator and a spherical shaped radiator, wherein the cone shaped radiator comprises a cone shape from a second vertex region to a transition region and the spherical shaped radiator comprises a spherical shape from the transition region to a top surface, wherein the second vertex region is electrically connected to the feed element mounted through the aperture of the cone shaped ground element, wherein a cone half-angle of the cone shaped radiator is between 30 degrees and 60 degrees, wherein the angle between the cone shaped radiator and the cone shaped ground element is about 67 degrees, wherein the spherical shaped radiator is mounted to the cone shaped radiator opposite the second vertex region such that the shape of the radiating element transitions from the cone shape of the cone shaped radiator to the spherical shape of the spherical shaped radiator at the transition region.

* * * * *